United States Patent [19]

Kemp, Jr. et al.

[11] Patent Number: 4,818,567

[45] Date of Patent: Apr. 4, 1989

[54] COATED METALLIC PARTICLES AND PROCESS FOR PRODUCING SAME

[75] Inventors: Preston B. Kemp, Jr., Athens; Robert J. Holland, Sr., Sayre, both of Pa.

[73] Assignee: GTE Products Corporation, Stamford, Conn.

[21] Appl. No.: 918,181

[22] Filed: Oct. 14, 1986

[51] Int. Cl.[4] ..... B05D 7/00; B22F 1/00

[52] U.S. Cl. ..... 427/216; 75/255; 427/217; 428/570

[58] Field of Search ..... 427/191, 192, 216, 217; 428/570; 75/255

[56] References Cited

U.S. PATENT DOCUMENTS 4,381,944 5/1983 Smith et al. ..... 75/255
4,584,078 4/1986 Nakanouchi et al. ..... 75/255 X
4,589,919 5/1986 Goodell et al. ..... 428/570 X
4,613,371 9/1986 Cheneg et al. ..... 75/255
4,643,765 2/1987 Takajo ..... 428/570 X

*Primary Examiner*—Michael Lusignan
*Attorney, Agent, or Firm*—Donald R. Castle; L. Rita Quatrini

[57] ABSTRACT

Metallic coated particles are disclosed which comprise a core consisting essentially of a material selected from the group consisting of metals, metal alloys, ceramics, ceramic glasses, and a coating relatively uniformly distributed on the core. The coating consists essentially of a relatively ductile and/or malleable metallic material selected from the group consisting of metals and metal alloys. The process for producing the coated particles involves increasing the aspect ratio of the ductile and/or malleable material, and mechanically applying it to a powder material which is to be the core of the particles.

9 Claims, No Drawings

COATED METALLIC PARTICLES AND PROCESS FOR PRODUCING SAME

BACKGROUND OF THE INVENTION

This invention relates to metallic coated particles having a core material and a coating. The coating consists essentially of a relatively ductile and/or malleable metal and the core consists essentially of a material which is relatively less deformable than the coating. The invention relates also to the process for producing the coated particles.

Present coating prior art relates to typically thin uniform coatings as applied by physical vapor deposition or chemical vapor deposition. While these coatings are precise, continuous, and usually effective, they suffer from several drawbacks. For example, the coating rate is relatively slow, thus making the process expensive and expensive capital equipment is required to apply the coating.

SUMMARY OF THE INVENTION

In accordance with one aspect of this invention, there is provided metallic coated particles which comprise a core consisting of metals, metal alloys, ceramics, ceramic glasses, and a coating relatively uniformly distributed on the core. The coating consists essentially of a relatively ductile and/or malleable metallic material selected from the group consisting of metals and metal alloys.

In accordance with another aspect of this invention, there is provided a process for producing the above described coated particles. The process involves increasing the aspect ratio of the ductile and/or malleable material, and mechanically applying it to a powder material which is to be the core of the particles.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

In accordance with one embodiment of this invention, metallic coated particles are produced which comprise a core consisting essentially of a material selected from the group consisting of metals, metal alloys, ceramics, and ceramic glasses, and a coating relatively uniformly distributed on the core, the coating consisting essentially of a relatively ductile and/or malleable metallic material selected from the group consisting of metals and metal alloys.

Typical coating metals are copper, copper alloys, aluminum, aluminum alloys, iron, iron alloys, nickel, nickel alloys, lead, and lead alloys. By ductile and/or malleable is meant that the coating metal is sufficiently more deformable than the core material of the particular core-coating combination to result in its being able to form a coating on the core.

The most preferred core materials are iron, iron alloys, steels, stainless steels, and cobalt alloys.

The core material is sufficiently less deformable than the coating material. This means that the core material will essentially hold its particle shape while the coating is applied. It is preferred that the hardness of the core be greater than the hardness of the coating. The core can be essentially brittle with the coating material having enough ductility and/or malleability to allow smearing on the surface of the core particles.

Some preferred combinations of this invention of core and coating are core of iron, iron alloys, or cobalt alloys with a coating of aluminum or aluminum alloys. An especially preferred combination is a core of iron and a coating of aluminum.

The preferred thickness of the coating is less than about 5 micrometers.

The preferred particle size of the coated particles is less than about 50 micrometers in diameter with less than about 20 micrometers in diameter being the more preferred and less than about 10 micrometers in diameter being especially preferred. The particle size measurement is done by conventional methods such as sedigraph, micromerograph, and microtrac with micromerograph being the preferred method. The diameter measurement is the largest measurement. However, the typical shape of the particles is spherical or near-spherical.

In accordance with another embodiment of this invention, the process for producing the previously described coated particles involves increasing the aspect ratio of a relatively ductile and/or malleable metal material which has been described previously, followed by mechanically applying the resulting material having the increased aspect ratio to a powder material which serves as the core of the coated particles. The powder material which is used in this process can be produced by plasma processing.

The aspect ratio as used in this invention is the ratio of the diameter of the particle to its thickness. The aspect ratio is increased to typically greater than about 50 to 1. This increased aspect ratio insures that an essentially flake geometry is achieved thus enabling the ductile and/or malleable metal to effectively coat the core material in the subsequent step.

The aspect ratio of the ductile and/or malleable metal is increased preferably by relatively high speed vibratory, rotary, or attritor milling with attritor ball milling being the especially preferred method. The speed of milling is a processing condition which depends upon the type of material, the thickness of coating desired which is generally equal to the thickness sought in the flakes produced, the type and design of the milling equipment, etc.

The resulting relatively ductile and/or malleable metal having the increased aspect ratio is then applied to the core metal by a mechanical smearing technique. This is accomplished by low speed vibratory, rotary, or attritor milling the ductile metal material with the core material. Attritor ball milling being especially preferred. These materials are milled over an extended period of time until the ductile material has effectively coated the core metal particles through mechanical action. Here again, specific milling conditions depend on material and processing factors as discussed previously.

The coated particles produced by the above described process are useful in applications requiring the physical-chemical properties of both materials, that is, core and coating.

The above described process may be employed to produce a feedstock for plasma melting, provided that there is a sufficient difference in the melting points of the core and coating. For example, coated particles consisting essentially of a tungsten metal core (high melting) and an aluminum coating (low melting) can be plasma processed to melt only the coating. This can result in a more uniform denser coating.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing coated powder particles, said process comprising:

(a) increasing the aspect ratio of relatively ductile and/or malleable metallic powder particles selected from the group consisting of metal powder particles and metal alloy powder particles to greater than about 50 to 1 by relatively high speed milling; and (b) mechanically applying the resulting ductile and/or malleable metallic particles having the increased aspect ratio to a powder material selected from the group consisting of metal powder, metal alloy powder, ceramic powder, and ceramic glass powder, by relatively low speed milling, said powder material being sufficiently less deformable than said ductile and/or malleable metallic powder, to produce coated particles consisting essentially of a core which consists essentially of said powder material and a coating relatively uniformly distributed on said core, said coating consisting essentially of said ductile and/or malleable metal, said coated particles having a particle size of less than about 50 micrometers in diameter.

2. A process of claim 1 wherein said aspect ratio is increased by relatively high speed attritor milling of said ductile and/or malleable metal.

3. A process of claim 1 wherein said core metal is selected from the group consisting of iron, iron alloys, steels, stainless steels, and cobalt alloys.

4. A process of claim 1 wherein the mechanical application step is accomplished by relativley low speed attritor milling of said powder material with said ductile and/or malleable metal having the increased aspect ratio.

5. A process of claim 1 wherein said ductile and/or malleable metal is selected from the group consisting of copper, copper alloys, aluminum, aluminum alloys, iron, iron alloys, nickel, nickel alloys, lead, and lead alloys.

6. A process of claim 1 wherein said core is selected from the group consisting of iron, iron alloys, and cobalt alloys, and said coating is selected from the group consisting of aluminum and aluminum alloys.

7. A process of claim 6 wherein said core is iron and said coating is aluminum.

8. A process of claim 1 wherein the particle size is less than about 20 micrometers in diameter.

9. A process of claim 8 wherein the particle size is less than about 10 micrometers in diameter.

* * * * *